US005102087A

United States Patent [19]

Brunell

[11] Patent Number: 5,102,087

[45] Date of Patent: Apr. 7, 1992

[54] PAGE SUPPORT APPARATUS

[76] Inventor: Arthur C. Brunell, 292 Brush Hill Ave. #102/7 Victoria Dr., West Springfield, Mass. 01089

[21] Appl. No.: 673,311

[22] Filed: Mar. 22, 1991

[51] Int. Cl.[5] ..... A47B 97/00

[52] U.S. Cl. ..... 248/451; 248/206.5; 248/448; 248/231.4

[58] Field of Search ..... 248/448, 451, 452, 453, 248/467, 206.5, 231.4, 442.2; 211/DIG. 1

[56] References Cited

U.S. PATENT DOCUMENTS

| | | | |
|---|---|---|---|
| 415,588 | 11/1889 | Swartz | 248/451 |
| 524,451 | 8/1894 | Ward | 248/451 |
| 871,113 | 11/1907 | DeLong, Sr. | 248/462 |
| 994,404 | 6/1911 | Jaggars | 248/451 |
| 1,130,559 | 3/1915 | Allen | 248/442.2 |
| 3,061,969 | 11/1962 | Lunday | 248/448 |
| 3,408,032 | 10/1968 | Francis | 248/451 X |
| 4,039,082 | 8/1977 | Ladinsky | 248/206.5 X |
| 4,953,714 | 9/1990 | Paul | 248/206.5 X |

FOREIGN PATENT DOCUMENTS

| | | | |
|---|---|---|---|
| 45500 | 9/1908 | Switzerland | 248/451 |

*Primary Examiner*—Karen J. Chotkowski
*Attorney, Agent, or Firm*—Leon Gilden

[57] ABSTRACT

An apparatus including a platform for supporting sheet members thereon, such as utilized in music recitals, reading, and the like, wherein the apparatus includes a mounting plate securable to the platform, with the mounting plate including a first clamp pair for securement to opposed sides of the platform, with a second clamp pair slidably mounted within the mounting plate to secure sheet members therebetween. The mounting plate is formed of a magnetic material for positioning the second clamp pair relative to the mounting plate.

1 Claim, 5 Drawing Sheets

PAGE SUPPORT APPARATUS

BACKGROUND OF THE INVENTION

1. Field of the Invention

The field of invention relates to sheet and book support apparatus, and more particularly pertains to a new and improved page support apparatus wherein the same is arranged for securement of sheets of various types between clamps of an associated apparatus.

2. Description of the Prior Art

Various support strcuture has been utilized in the prior art to mountingly secure books and the like for ease of reading thereon. The instant invention attempts to overcome deficiencies of the prior art by providing a new and improved page support apparatus arranged for positioning light-weight sheet members thereon in a fixed orientation relative to an underlying support platform. Examples of the prior art include U.S. Pat. No. 4,712,760 to Winter wherein a book rest includes an underlying support with a slot therein to receive a plate within the slot, and the plate includes hook members to secure the book to the plate.

U.S. Pat. No. 4,925,144 to White sets forth a portable book holder utilizing a unitary main member connected at one end to position a book in contact with an end portion of the main member.

U.S. Pat. No. 4,886,231 to Doerksen sets forth a portable book stand utilizing a support platform, with pivoted rods arranged to position a book on the organization.

U.S. Pat. No. 4,116,414 to Robertson sets forth a support platform mounting clamps at ends of tether lines to secure a book between the clamp members.

As such, it may be appreciated that there continues to be a need for a new and improved page support apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of book support apparatus now present in the prior art, the present invention provides a page support apparatus wherein the same is arranged for the positioning and mounting of various sheets of music or the like between opposed clamps. As such, the general purpose of the present invention, which will be described subsequently in greater detail, is to provide a new and improved page support apparatus which has all the advantages of the prior art page support organizations and none of the disadvantages.

To attain this, the present invention provides an apparatus including a platform for supporting sheet members thereon, such as utilized in music recitals, reading, and the like, wherein the apparatus includes a mounting plate securable to the platform, with the mounting plate including a first clamp pair for securement to opposed sides of the platform, with a second clamp pair slidably mounted within the mounting plate to secure sheet members therebetween. The mounting plate is formed of a magnetic material for positioning the second clamp pair relative to the mounting plate.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved page support apparatus which has all the advantages of the prior art page support organizations and none of the disadvantages.

It is another object of the present invention to provide a new and improved page support apparatus which may be easily and efficiently manufactured and marketed.

It is a further object of the present invention to provide a new and improved page support apparatus which is of a durable and reliable construction.

An even further object of the present invention is to provide a new and improved page support apparatus which is susceptible of a low cost of manufacture with regard to both materials and labor, and which accordingly is then susceptible of low prices of sale to the consuming public, thereby making such page support apparatus economically available to the buying public.

Still yet another object of the present invention is to provide a new and improved page support apparatus which provides in the apparatuses and methods of the prior art some of the advantages thereof, while simultaneously overcoming some of the disadvantages normally associated therewith.

Still another object of the present invention is to provide a new and improved permitting ease of assemblage of the structure to secure a page of sheet music or the like between opposed clamps of a second clamp pair, with a first clamp pair utilized to secure the organization to an underlying support platform.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 6 is an isometric illustration of a modified page support apparatus utilizing the modified clamp structure as set forth in FIGS. 4 and 5.

FIG. 7 is a further modified aspect of the instant invention.

DESCRIPTION OF THE PREFERRED EMBODIMENT

Figure 1:
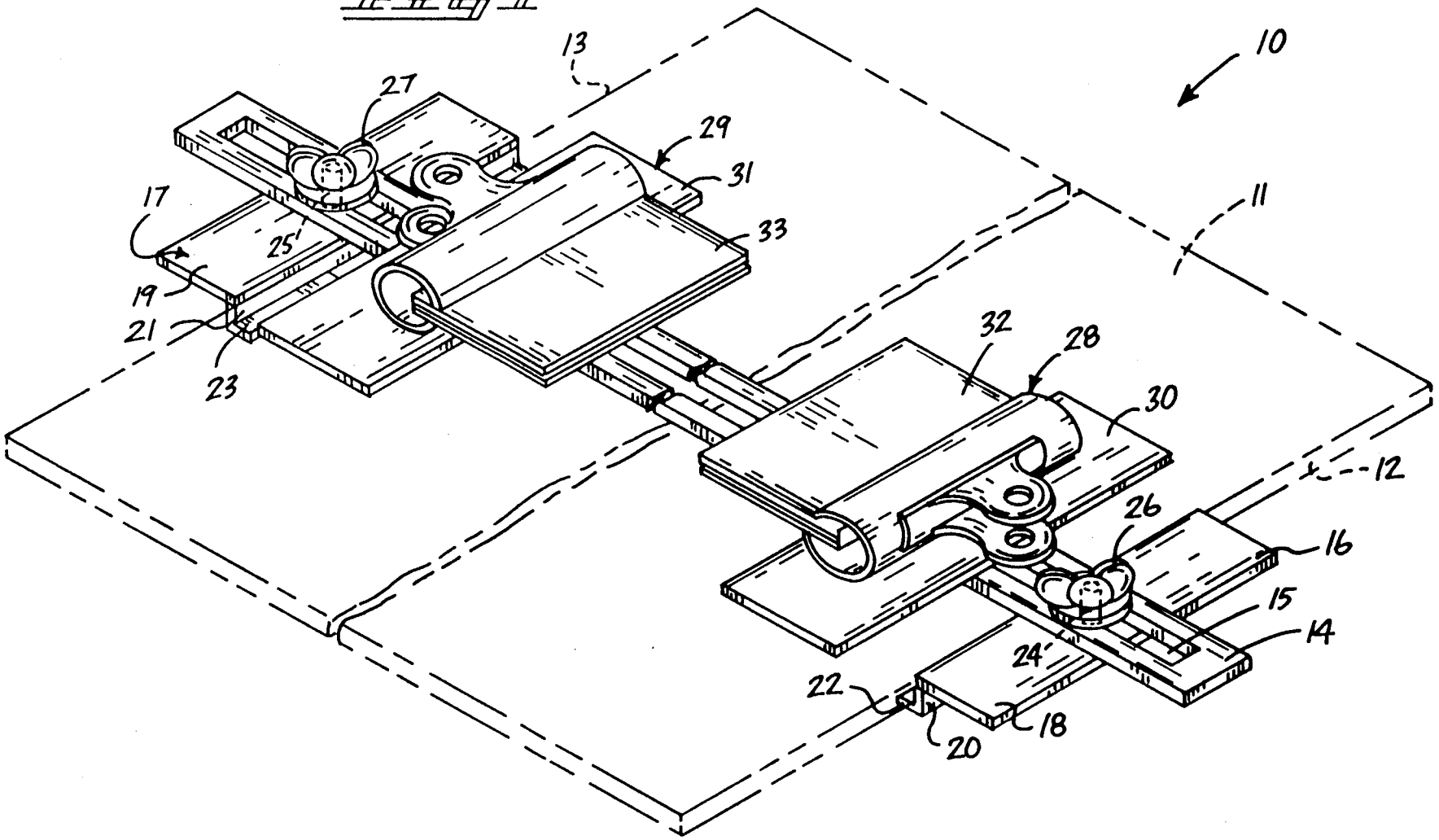
FIG. 1 is an isometric illustration of the instant invention.
Figure 2:
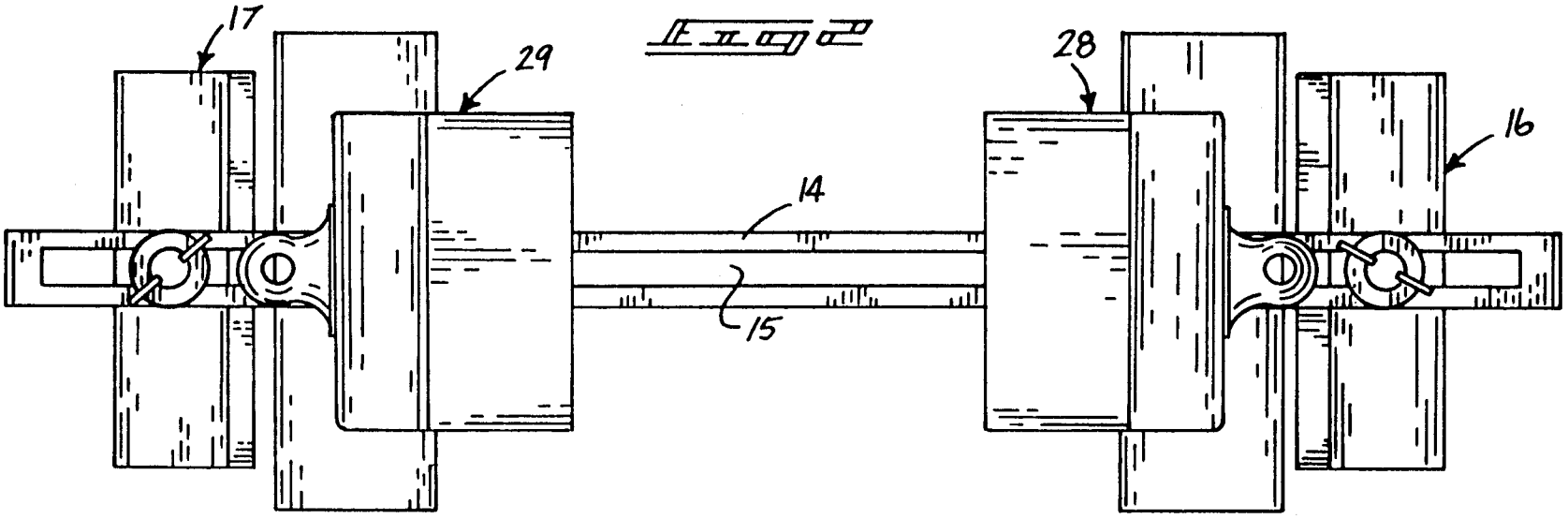
FIG. 2 is an orthographic top view of the instant invention.
Figure 3:
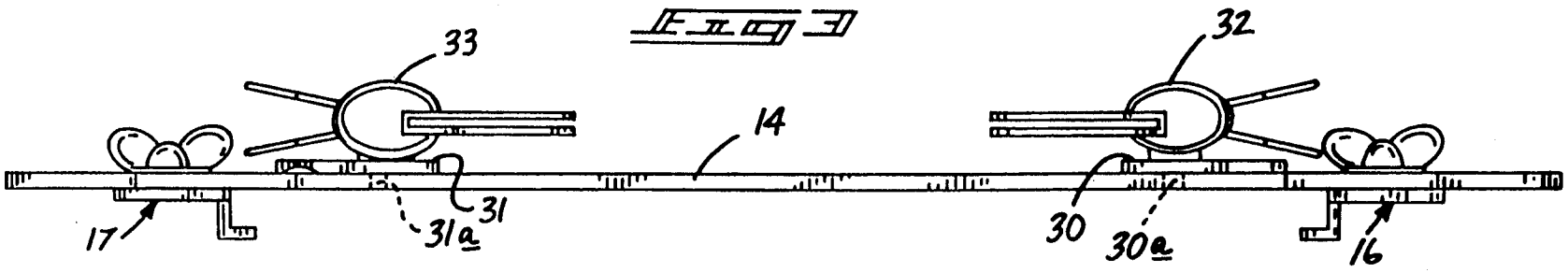
FIG. 3 is an orthographic side view of the instant invention.

With reference now to the drawings, and in particular to FIGS. 1 to 7 thereof, a new and improved page support apparatus embodying the principles and concepts of the present invention and generally designated by the reference numerals 10, 10*a*, and 10*b* will be described.

More specifically, the page support apparatus 10 of the instant invention essentially comprises a support platform 11 defined by a planar top surface and spaced parallel first and second side edges 12 and 13 respectively. The side edges 12 and 13 are orthogonally oriented relative to the planar top surface of the support platform 11. A mounting plate 14 is positionable over the top surface of the support platform 11, and includes an elongate through-extending and closed slot 15. The slot 15 is defined by a predetermined length, whereas a spacing between the first and second side edges is defined by a predetermined width that is less than the predetermined length. A first clamp member 16 is mounted relative to the mounting plate 14 spaced from a second clamp member 17, wherein the first and second clamp members 16 and 17 define a first clamp pair, each slidably mounted to a bottom surface of the mounting plate 14, with the first and second clamp members 16 and 17 positioned adjacent and into contiguous communication with the respective first and second sides 12 and 13.

The first clamp member 16 includes a first platform flange 18 that is substantially coextensively aligned with the top surface of the support platform 11, whereas the second clamp member 17 defined as a mirror image of the first clamp member 16 includes a second platform flange 19 that is coextensively aligned with the top surface of a support platform 11. The first and second platform flanges 18 and 19 respectively are fixedly mounted to a first and second abutment flange 20 and 21. coextensive with and orthogonally oriented relative to forward edges of the first and second platform flanges 18 and 19, whereas each of the first and second abutment flanges 20 and 21 are slidable into contiguous communication with the first and second sides 12 and 13 coextensively about a forward face of each of the abutment flanges 20 and 21. The abutment flanges 20 and 21 are defined by a predetermined height substantially equal to a predetermined thickness defined by the support platform 11, whereas the first abutment flange 20 mounts a first bottom flange 22 orthogonally to a bottom edge of the first abutment flange 20, with the first bottom flange 22 extending in communication with a bottom surface of the support platform 11. Similarly, a second bottom flange 23 mounted to a lower edge of the second abutment flange 21 extends under the support flange 11 to the bottom surface thereof adjacent the second side 13. The support platform 11 is accordingly clamped by the first clamp pair to permit vertical positioning of the mounting plate 14 about a top surface of the support platform 11. To permit slidable positioning of each clamp member of the first clamp pair along the top surface of the mounting plate 14 a respective first and second threaded boss 24 and 25 are orthogonally and medially mounted to a top surface of the respective first and second platform flange 18 and 19. A respective first and second fastener 26 and 27 is threadedly securable to the first and second threaded boss 24 and 25 to overlie a top surface of the mounting plate 14 as the threaded bosses 24 and 25 extend through the slot 15.

A second clamp pair is provided to include a respective third and fourth clamp member 28 and 29 that are slidably mounted along the top surface of the mounting plate 14 and that portion thereof that is positioned between the first and second sides 12 and 13. The third and fourth clamp members 28 and 29 each include a ferro magnetic first and second slide plate 30 and 31 respectively magnetically adherable along the mounting plate 14 that is formed of a ferro magnetic attractive material. To maintain alignment of the first and second slide plates 30 and 31 relative to the slot 15, a respective first and second plate boss 30*a* and 31*a* is orthogonally mounted to a respective bottom surface of each of the respective first and second slide plates 30 and 31, with each boss 30*a* and 31*a* slidably receivable within the slot 15 and each defined by a height not to exceed a depth of the slot 15 within the mounting plate 14. A respective first spring clip 32 and a second spring clip 33 are fixedly mounted to a top surface of the respective first and second slide plates 30 and 31 to secure a sheet member therebetween.

Figure 4:
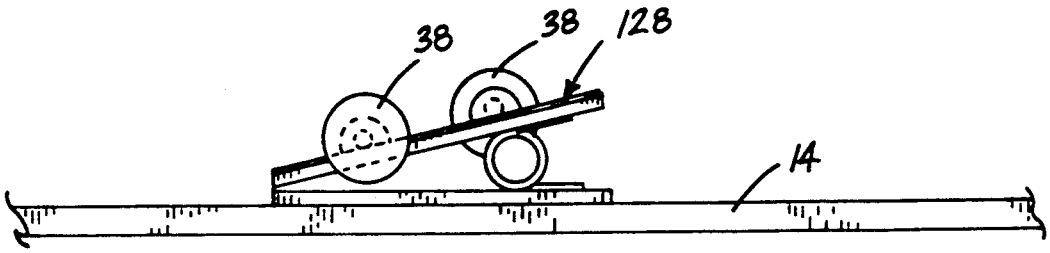
FIG. 4 is an orthographic side view of a modified clamp structure utilized by the instant invention.
Figure 5:
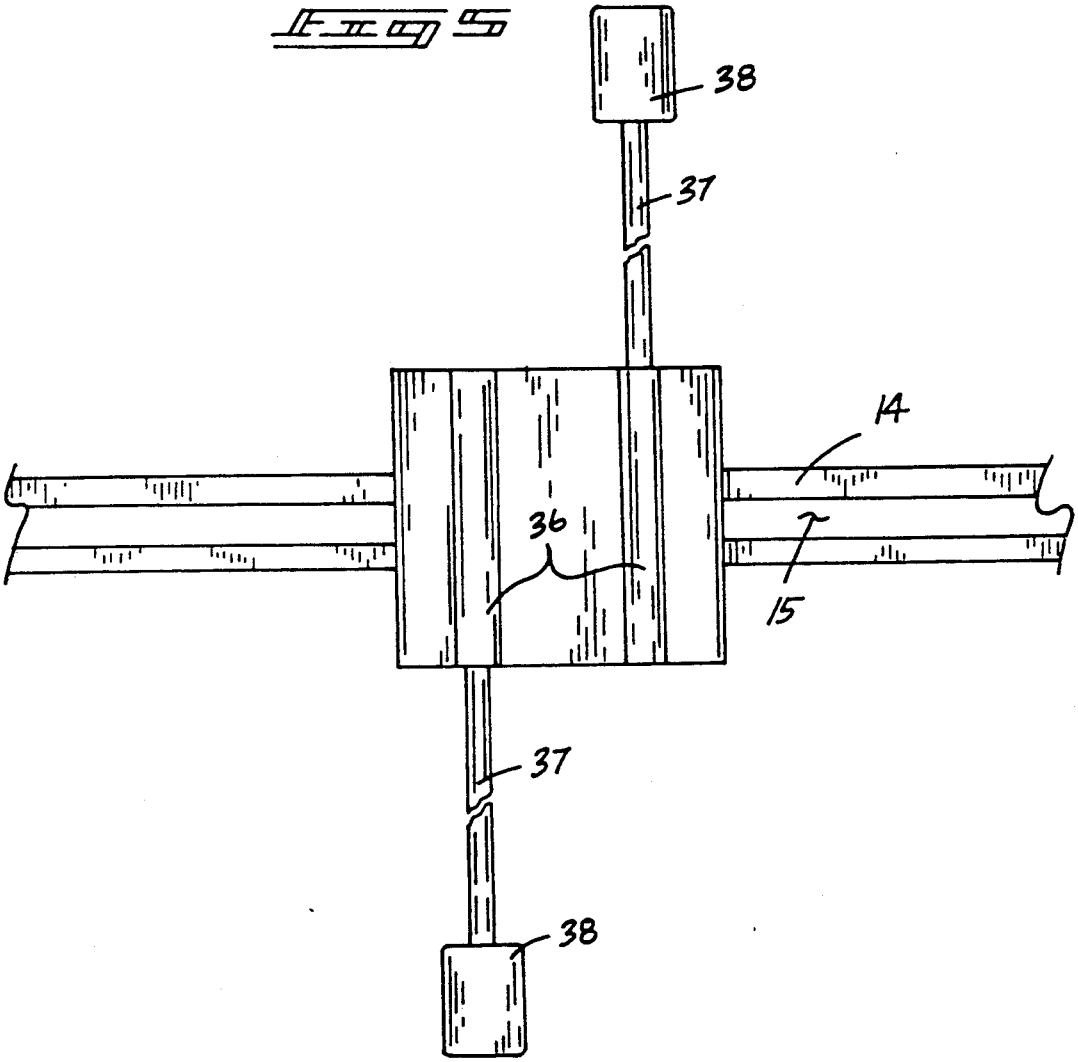
FIG. 5 is an orthographic top view of the modified clamp structure as set forth in FIG. 4.
Figure 5:
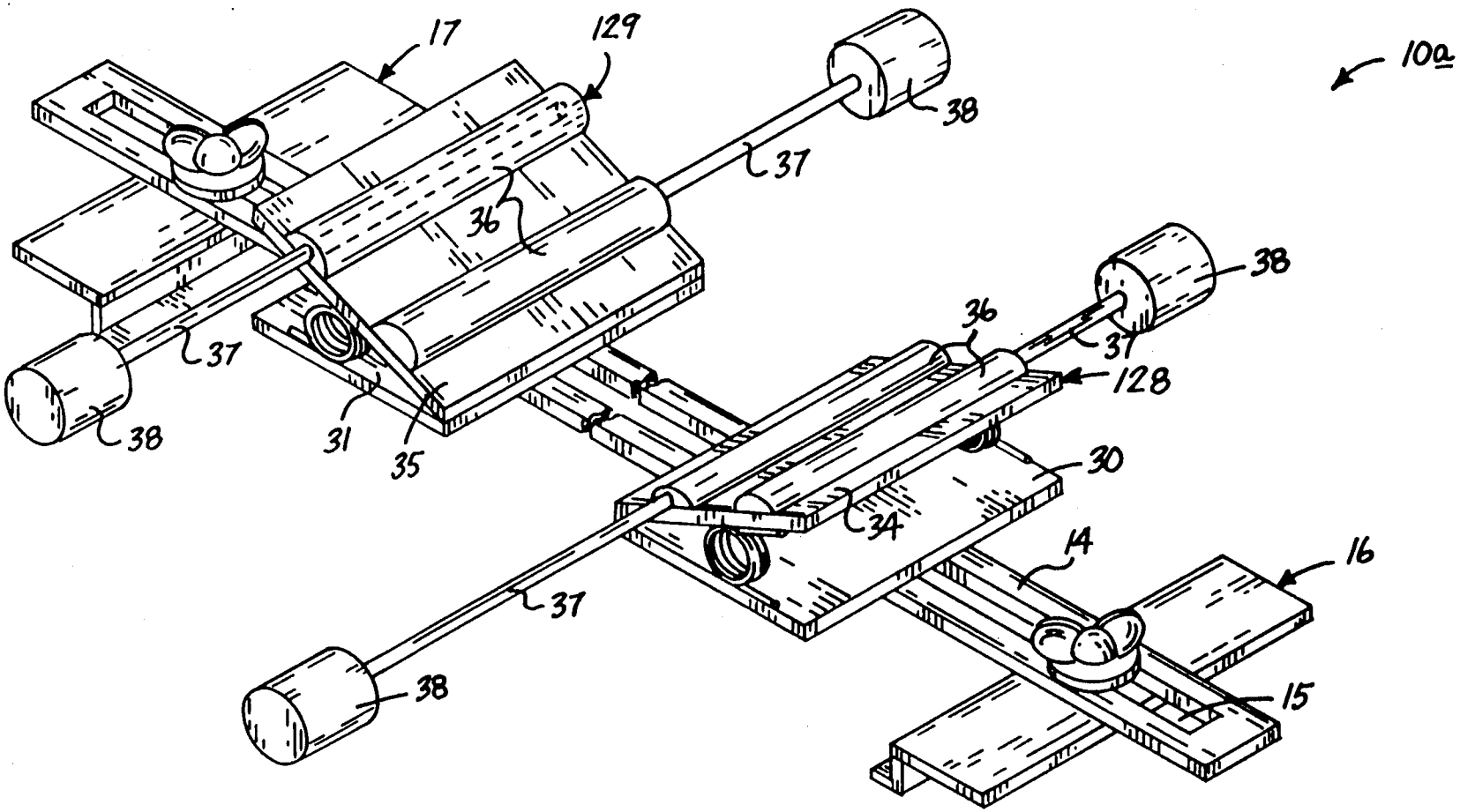
Figure 11:
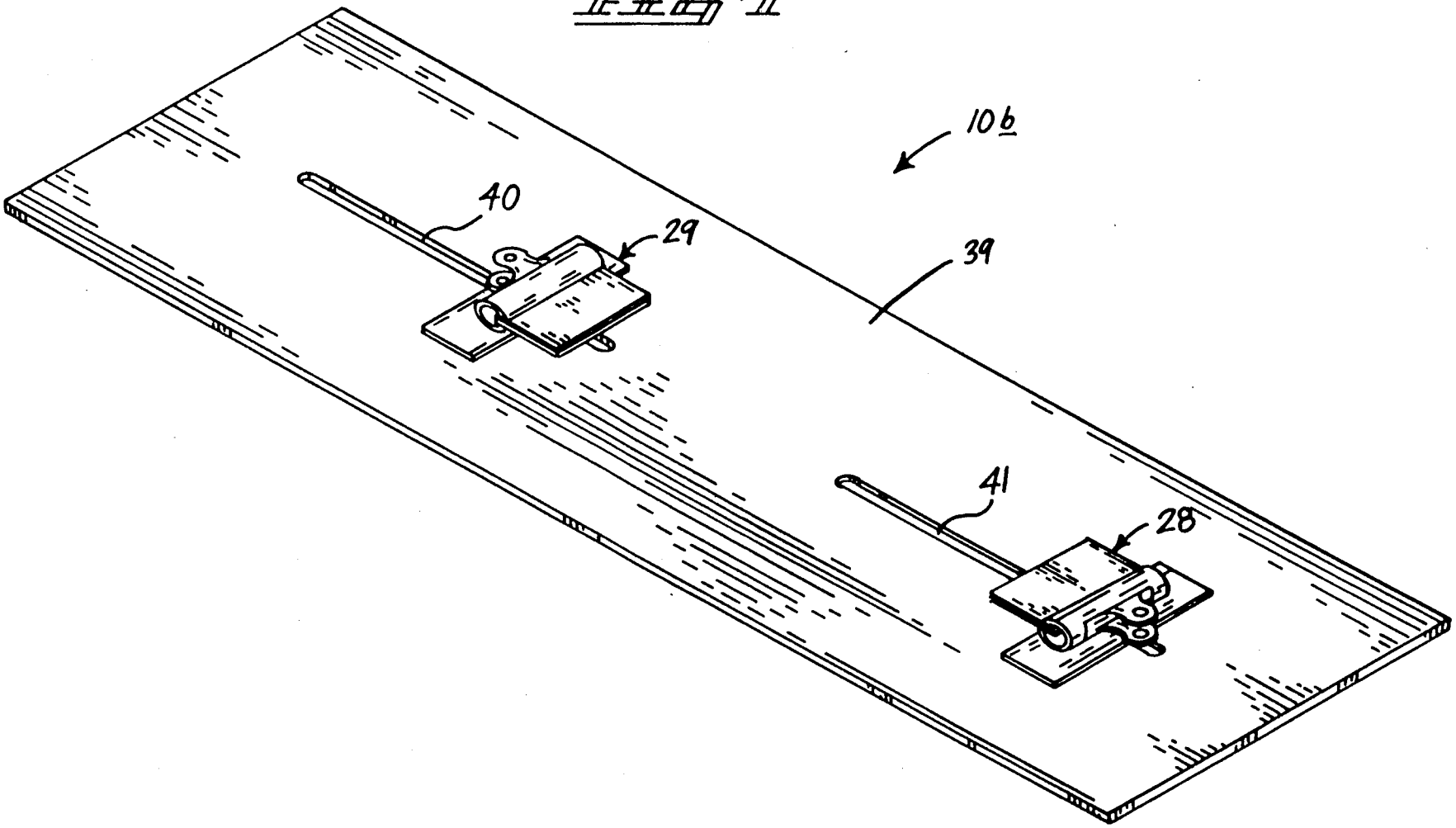

Alternatively, reference to FIGS. 4 and 6 illustrate the use of a modified third and fourth clamp member 128 and 129 respectively that includes a respective first and second spring biased jaw plate 34 and 35 mounted to the top surface of the first and second slide plates 30 and 31. In the embodiment of FIG. 6 for example set forth as 10*b*, each of the respective third and fourth clamp members 128 and 129 include spaced parallel upper and lower boss members. Each of the boss members includes a cylindrical cavity therewithin, wherein the cylindrical cavities are parallel relative to one another and extend through opposed ends of respective upper and lower boss members to telescopingly receive parallel flexible upper and lower slide rods 37, each telescopingly received within a respective cylindrical cavity. Each of the slide rods 37 includes an abutment cylinder mounted at a free terminal end of each slide rod to enhance stability of a sheet of paper mounted between each of the third and fourth clamp members to provide stability to such a sheet member when used in an environment subject to wind gusts and the like to maintain the paper sheet in a relatively flattened configuration relative to the top surface of the support platform 11.

The embodiment, as illustrated in FIG. 7, set forth as 10*b*, includes a modified support platform 39, including first and second slots 40 and 41 that are aligned relative to one another, wherein the first and second slots 40 and 41 mount a third and fourth clamp member 28 and 29 thereon. The embodiment of FIG. 7 may be utilized as a portable platform structure positionable upon a piano and the like for holding sheet music between the third and fourth clamp members 28 and 29.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A page support apparatus comprising, a support platform, the support platform including a platform top surface and a platform bottom surface, and a first side spaced from a parallel a second side, and a mounting plate, the mounting plate positioned in contiguous communication with the platform top surface, and the mounting plate including a first clamp pair means for securement of the mounting plate to the first side and second side, and a second clamp pair means for securement of a flexible workpiece therebetween, and wherein the first clamp pair means includes a first clamp member, wherein the first clamp member includes a first platform flange aligned with the support platform top surface, and the first platform flange including a first abutment flange orthogonally mounted to a forward edge of the first platform flange, with the first abutment flange in contiguous communication with the first side, and a first bottom flange fixedly mounted to a lower terminal end of the first abutment flange, with the first bottom flange in communication with the support platform bottom surface, and the first clamp pair means including a second clamp member, with the second clamp member including a second abutment flange aligned with the support platform top surface, and a second bottom flange fixedly and orthogonally mounted to a forward edge of the second abutment flange, with the second abutment flange in contiguous communication with the second side of the support platform, and a second bottom flange fixedly and orthogonally mounted to a lower terminal edge of the second abutment flange, with the second bottom flange in contiguous communication with the platform bottom surface adjacent the second side, and wherein the mounting plate includes an elongate through-extending enclosed slot directed longitudinally of the mounting plate, and the slot is defined by a predetermined length, and the support platform is defined by a predetermined width between the first side and the second side, wherein the predetermined length is greater than the predetermined width, and a first threaded boss fixedly and orthogonally mounted medially of a first platform flange top surface, and the first threaded boss directed through the enclosed slot, and a first fastener secured to the first threaded boss to clamp the mounting plate between the first platform flange and the first fastener, and a second threaded boss fixedly and orthogonally mounted medially of a second platform flange top surface, with the second threaded boss directed through the slot, and a second fastener securable to the second threaded boss the clamp the mounting plate between the second abutment flange and the second fastener, and wherein the second clamp pair includes a third clamp member, with the third clamp member including a first slide plate, the first slide plate formed of a ferromagnetic material, and the mounting plate formed of a ferro material to effect magnetic attraction between the first slide plate and the mounting plate, and the second clamp pair means including a fourth clamp member, with the fourth clamp member including a second slide plate mounted to a top surface of the mounting plate, with the second slide plate formed of a ferromagnetic material, and the first slide plate including a first spring plate member mounted thereon, and the second slide plate including a second spring plate member mounted thereon, and the first slide plate including a first slide plate boss fixedly and medially mounted to a bottom surface of the first slide plate, with the first slide boss extending downwardly through the slot, and the second slide plate including a second slide plate boss fixedly and orthogonally mounted medially to a bottom surface of the second slide plate, with the second slide plate boss directed through the slot, and wherein the first spring plate member includes a plurality of spaced parallel bosses secured to a top surface of the first spring plate member, wherein each boss member includes a cylindrical cavity, with each cylindrical cavity including a flexible slide rod telescopingly mounted therewithin extending orthogonally relative to the mounting plate, with each slide rod including an abutment cylinder mounted to a free terminal end of each slide rod spaced from the spring plate member, and the second spring plate member including a plurality of further boss members arranged in a parallel relationship to a top surface of a second spring plate member, with the further boss members including a cylindrical cavity formed therewithin, wherein each cylindrical cavity includes a further slide rod telescopingly mounted therewithin, wherein each further slide rod includes a further abutment cylinder formed to a predetermined end of each slide rod orthogonally oriented relative to the mounting plate.

* * * * *